United States Patent [19]

Pfeifer et al.

[11] 3,966,316

[45] June 29, 1976

[54] ELECTROSTATIC COPYING MACHINE WITH REMOVABLE COPYING DRUM

[75] Inventors: Josef Pfeifer, Unterhaching; Günther Schnall, Eching, both of Germany

[73] Assignee: AGFA-Gevaert, A.G., Leverkusen, Germany

[22] Filed: July 24, 1975

[21] Appl. No.: 598,882

[30] Foreign Application Priority Data

July 27, 1974 Germany ..... 2436301

[52] U.S. Cl. ..... 355/3 R; 355/15

[51] Int. Cl.[2] ..... G03G 15/00

[58] Field of Search ..... 355/3 R, 15, 133, 11, 355/16, 17, 3 DR

[56] References Cited

UNITED STATES PATENTS

| | | | |
|---|---|---|---|
| 3,490,841 | 1/1970 | Cely et al. | 355/3 DR |
| 3,667,840 | 6/1972 | Engel et al. | 355/3 DR |
| 3,689,146 | 9/1972 | Ito et al. | 355/3 DR |
| 3,736,053 | 5/1973 | Shreeve et al. | 355/3 DR |
| 3,879,124 | 4/1975 | Eppe et al. | 355/15 |
| 3,883,242 | 5/1975 | Takahashi et al. | 355/3 DR |

*Primary Examiner*—R. L. Moses
*Attorney, Agent, or Firm*—Michael J. Striker

[57] ABSTRACT

An electrostatic copying machine wherein the copying drum and the cleaning unit for the photosensitive layer of the drum are mounted in the plastic casing of a module which can be inserted into the stationary main portion of the housing upon pivoting of a cover to open position. The main housing portion and the cover carry rollers which automatically center the copying drum of a properly inserted module when the cover is moved back to closed position. The casing of the module has a vessel for a supply of developing or fixing liquid and means for automatically feeding liquid to a tank in the main portion of the housing when the supply of liquid in the tank descends below a predetermined level. One of the rollers can be driven by the motor of the copying machine to rotate the drum when the latter is properly centered in the housing.

21 Claims, 9 Drawing Figures

ELECTROSTATIC COPYING MACHINE WITH REMOVABLE COPYING DRUM

BACKGROUND OF THE INVENTION

The present invention relates to improvements in electrostatic copying machines of the type wherein the image of an original is transferred onto a photosensitive layer and is thereupon developed with a pulverulent or liquid developing agent prior to being transferred onto a preferably sheet-like copy carrier. The photosensitive layer of an electrostatic copying machine is often applied to the periphery of a rotary copying drum. The drum must be inspected, repaired or replaced at certain intervals. In presently known copying machines, the removal of that component which is provided with the photosensitive layer is a tedious and time-consuming task because the component must be mounted in a predetermined position with a high degree of accuracy in order to insure proper imaging of originals, development of images and transfer of developed images onto a copy carrier. Such work must be performed by skilled persons and invariably necessitates lengthy interruptions in operation of the copying machine. Additional problems arise in connection with cleaning of the aforementioned component for the purpose of removing from the photosensitive layer remnants of a pulverulent or liquid developing agent. Such remnants accumulate in the housing and must be removed from time to time in order to reduce the likelihood of contamination of the machine and/or of the surrounding area (if the developing agent includes solid toner particles). The parts of the cleaning unit undergo considerable wear so that they must be replaced at rather frequent intervals. In many instances, the wear upon the parts of the cleaning unit for the photosensitive layer progresses at the same rate as the wear upon the component which is provided with the photosensitive layer. The parts which clean the photosensitive layer may constitute or include rotary brushes, endless bands, bands of finite length or the like.

It was already proposed to assemble the parts of the cleaning unit for the photosensitive layer in an electrostatic copying machine into a self-sustaining module which can be inserted into and removed from the housing of the copying machine with little loss in time. Reference may be had to commonly owned U.S. Pat. No. 3,672,764 granted June 27, 1972 to Hartwig et al. Such modular construction of the cleaning unit contributes to simplicity of the copying machine and reduces the intervals of idleness; however, the removal of a defective component which is provided with a photosensitive layer or the mounting of a new component in the housing of a conventional copying machine is still a tedious and time-consuming task so that the modular construction of the cleaning unit cannot be used to full advantage, especially if the cleaning unit must be removed simultaneously with the aforementioned component (e.g., a rotary copying drum).

SUMMARY OF THE INVENTION

An object of the invention is to provide an electrostatic copying machine which is constructed and assembled in such a way that all parts or components which require frequent removal for the purposes of inspection, repair and/or replacement may be removed from or inserted into the housing of the copying machine in a time-saving manner and without resorting to special tools.

Another object of the invention is to provide an electrostatic copying machine wherein the copying component (e.g., a rotary drum whose periphery is coated with a layer of photosensitive material) can be removed from or inserted into the housing of the copying machine within a fraction of the time which is needed for such operation in a conventional electrostatic copying machine.

A further object of the invention is to provide a novel and improved self-sustaining module for use in an electrostatic copying machine.

An additional object of the invention is to provide an electrostatic copying machine wherein the removal or insertion of cleaning means for the copying drum takes up the same amount of time as the removal or insertion of the copying drum.

Still another object of the invention is to provide an electrostatic copying machine with novel and improved means for centering and moving that component of the machine which carries the image of an original toward and beyond the developing unit of the machine.

A further object of the invention is to provide an electrostatic copying machine with a novel and improved module which includes means for cleaning or sweeping the copying drum.

The improved electrostatic copying machine comprises a housing which preferably includes a stationary main portion and a second portion (e.g., a cover or lid) which is movable with respect to the main portion between a first or closed position and a second or open position, centering means mounted in the housing, and a self-sustaining module removably installed in the housing so as to be accessible for removal upon movement of the second housing portion to the second position, a mobile copying component (preferably a rotary drum having at its periphery coated with a photosensitive layer) installed in a casing of the module, and means for cleaning the copying component (such cleaning means may comprise a rotary brush, a belt or a doctor mounted in the casing of the module). The centering means engages and locates the copying component in the housing and includes at least one motion transmitting member (e.g., a friction roller or a gear) which is actuatable (e.g., by starting the prime mover of the copying machine) to move the copying component with respect to the housing and with respect to the casing of the module. The cleaning device sweeps the photosensitive layer of the drum when the latter is caused to rotate in the housing. The centering means may comprise a plurality of rotary members (rollers and/or gears) and these rotary members preferably include at least one rotary member in the main portion and at least one rotary member in the second portion of the housing. The rotary member or members in the second portion of the housing will engage the drum (preferably the one and/or the other end portion of the drum) when the second portion of the housing is moved to the first position (subsequent to insertion of a module into the main portion of the housing.

The module preferably further comprises means (e.g., convex protuberances on two side walls of the casing) for loosely mounting the drum in the casing. The clearances between the just mentioned mounting means and the drum are sufficient to insure that the drum can be held or moved to a predetermined position when engaged by the rotary members in the main and second portions of the housing.

The novel features which are considered as characteristic of the invention are set forth in particular in the appended claims. The improved copying machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 2:
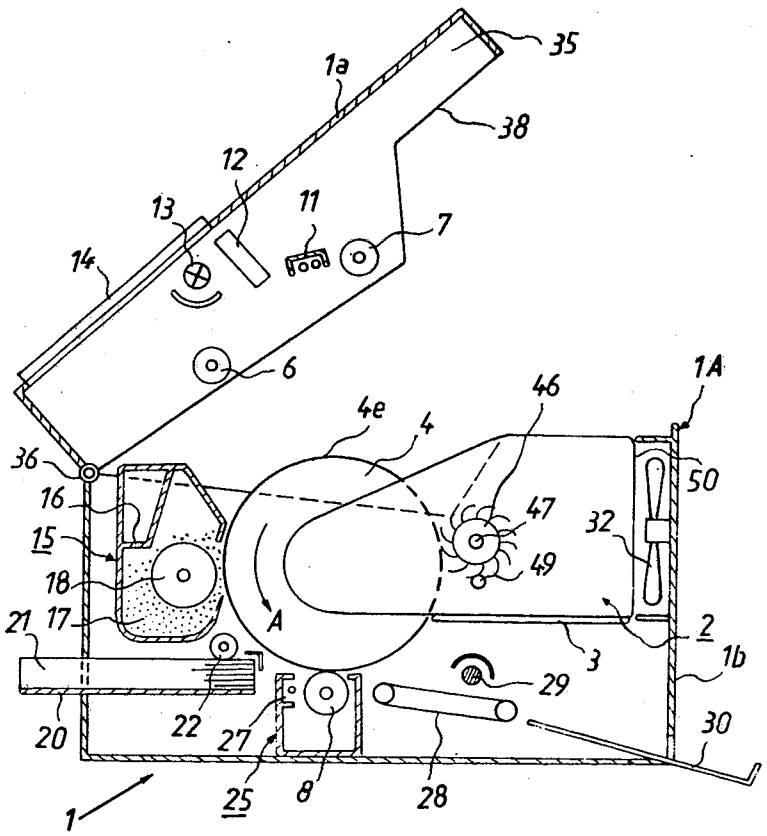
FIG. 2 shows the structure of FIG. 1 but with the movable portion of the housing in open position so that the module is accessible for removal from the stationary portion of the housing.
Figure 1:
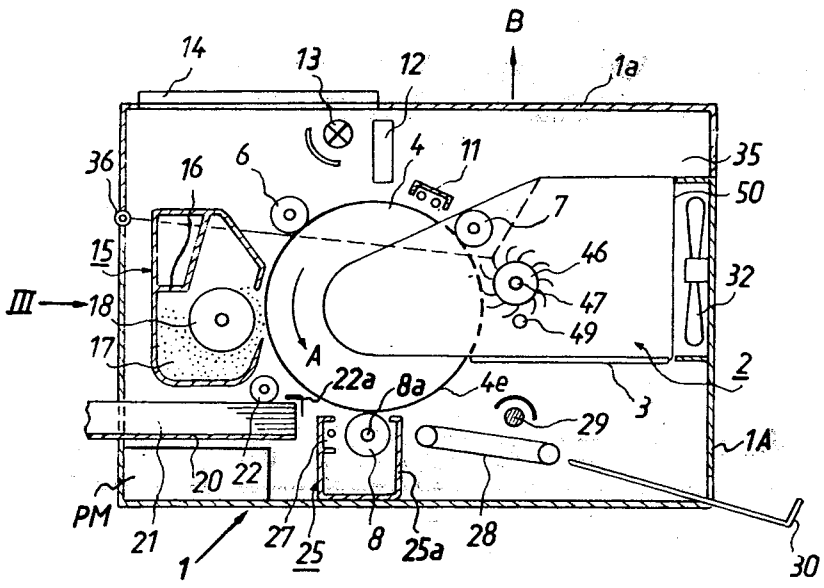
FIG. 1 is a schematic longitudinal vertical sectional view of an electrostatic copying machine having a removable module which embodies one form of the invention, the movable portion of the housing of the copying machine being shown in closed position.

Referring first to FIGS. 1 and 2, there is shown an electrostatic copying machine having a housing or frame 1 with a top wall 1*a* which forms part of a movable housing portion 35 constituting a cover or lid which is pivotablly attached to a stationary main portion 1A of the housing by a horizontal hinge 36. The housing 1 contains and supports a removable module 2 which can be reached upon pivoting of the cover 35 to the open or raised position of FIG. 2. The module 2 (shown on a larger scale in FIGS. 3 and 4) comprises a casing 2A for a copying component 4 here shown as a rotary drum and for a drum-cleaning or wiping unit having a rotary cylindrical brush 46. The drum 4 is coated with a layer 4*e* of photosensitive material and rests (when the module 2 is properly installed in the main portion 1A of the housing 1) on a centering roller 8 which is rotatable on a horizontal shaft 8*a* journalled in the side walls of the main housing portion 1A. When the cover 35 is returned to the closed position of FIG. 1, the drum 4 is engaged and centered by two additional rollers 6, 7 whose shafts are mounted in the side walls of the cover and one of which (e.g., the roller 6) preferably serves as a motion transmitting means for rotating the drum in a counterclockwise direction (see the arrow A). Each of the centering rollers 6, 7, 8 may consist of several coaxial rollers or wheels and the positions of rollers 6–7 and 8 may be reversed, i.e., the roller 8 can be mounted in the cover 35 if the rollers 6, 7 are mounted in the main housing portion 1A.

In accordance with a feature of the invention, the rollers 6, 7 preferably engage only the end portions 4*a*, 4*b* (FIG. 3) of the drum 4 so that they cannot contact the photosensitive layer 4*e*. For example, each of the rollers 6, 7 may comprise two spaced apart coaxial wheels one of which engages the end portion 4*a* and the other of which engages the end portion 4*b* of the copying drum 4. One wheel of the roller 6 or 7 preferably constitutes a gear or pinion which meshes with the teeth of a ring gear 10 occupying a part of or the entire portion 4*a* of the drum 4. The means for rotating the just mentioned wheel of the roller 6 may comprise an electric motor or another suitable prime mover PM.

When the casing 2A of the module 2 is properly installed in the main housing portion 1A and the cover 35 is returned to the closed position of FIG. 1, and when the roller 6 drives the drum 4 in the direction indicated by arrow A, successive increments of the photosensitive layer 4*a* travel past a corona 11 which serves to electrically charge the layer 4*e*, thereupon along an exposing unit 12 which includes one or more light sources 13 and serves to image an original onto the layer 4*e*, thereupon along a developing unit 15, thereupon along a combined transfer and fusing or fixing unit 25, and finally along the cleaning unit including the brush 46. The corona 11, the exposing unit 12 and the light source 13 are mounted in the cover 35. The developing unit 15 comprises a container 16 for a supply 17 of developing agent (e.g., carriers for toner particles) and a rotary applicator 18 which feeds developing agent against the latent image on the photosensitive layer 4*e*. The original to be copied is placed onto a transparent platform 14 installed in the wall 1*a* of the cover 35. The exact nature of the exposing unit 12 forms no part of the invention; it suffices to say that this unit can image an original on the platform 14 onto the photosensitive layer 4*e* so that the latter carries a latent image of the original toward and past the applicator 18. The image is thereby converted into a powder image.

The housing 1 further contains a tray 20 which is mounted in the main portion 1A at a level below the developing unit 15 and contains a stack 21 of superimposed copy carriers 21A, e.g., paper sheets, A feeding roll 22 is driven, when necessary, to advance the uppermost copy carrier 21A from the stack 21 toward the unit 25. The feeding roll 22 cooperates with suitable corner separators 22*a* to insure that the copy carriers 21A are removed from the stack 21 one at a time.

The combined transfer and fixing unit 25 is disposed immediately below the lowermost portion of the copying drum 4 and comprises a corotron 27 serving to electrically charge the roller 8 which dips into a body of fixing liquid in the tank 25*a*. The roller 8 has a coating of dielectric material. The manner in which the unit 25 transfers powder images from the layer 4*e* onto successive copy carriers is disclosed in detail in German application Ser. No. P 24 08 245.9 and is shown in FIG. 4*a*. A copy carrier 21A which advances beyond the roller 8 is provided with a fixed image of the original on the platform 14 and is caused to descend onto the upper reach of an inclined belt conveyor 28 serving to transport successive copy carriers past a heating unit or dryer 29 and to deposit successive copy carriers into a downwardly inclined chute 30 a portion of which extends through the end wall 1*b* of the main housing portion 1A so that the copy carriers can be readily removed, either singly or in stacks. The dryer 29 is preferably mounted immediately above the upper reach of the conveyor 28.

The direction in which the cover 35 is pivotable from the closed position of FIG. 1 to the open position of FIG. 2 is indicated by arrow B. The prime mover PM transmits motion to a power train which drives the aforementioned wheel or gear of the roller 6. The power train is preferably mounted in such a way that the gear of the roller 6 is automatically disengaged from the prime mover PM when the cover 35 is pivoted to the position of FIG. 2. The extent to which the cover 35 is pivotable from the closed position of FIG. 1 is sufficient to allow for convenient removal of the module 2 as well as for reinsertion of the module (or for insertion of a fresh module) into the main portion 1A of the housing. The cover 35 and the main portion 1A may be equipped with suitable locking means for normally holding the cover in the position of FIG. 1.

The casing 2A of a properly inserted module 2 rests on strip-shaped supporting members 3 of the main portion 1A. The top part of such module may be engaged and held against movement with respect to the main portion 1A by edge faces 38 at the undersides of the side walls of the cover 35; these edge faces engage the casing 2A when the cover 35 is pivoted back to the position of FIG. 1.

Figure 3:
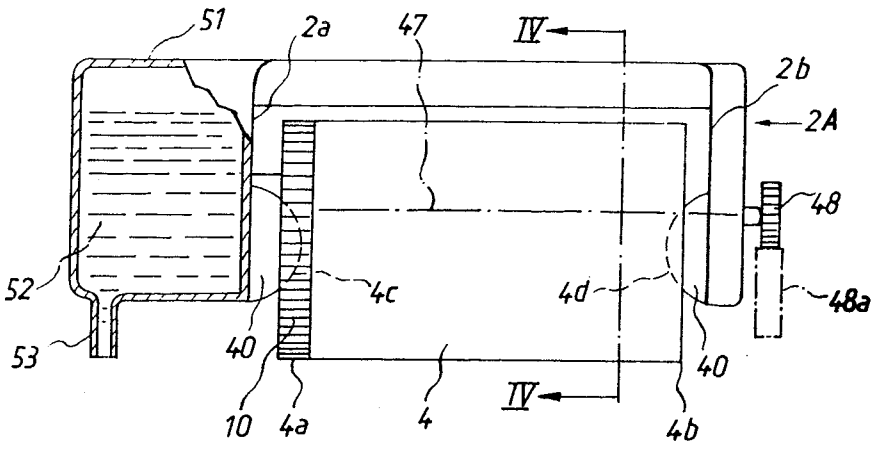
FIG. 3 is an enlarged and elevational view of the module as seen in the direction of arrow III in FIG. 1.
Figure 4:
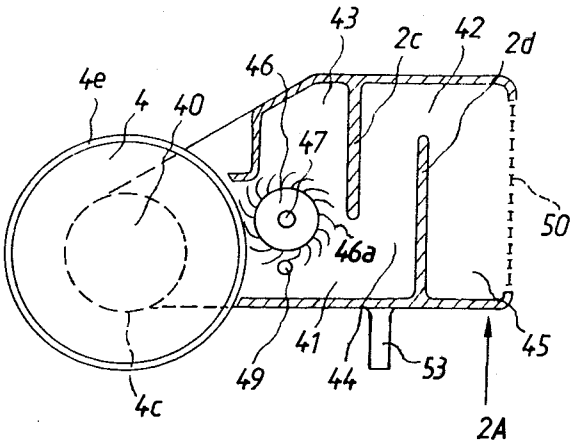
FIG. 4 is a sectional view of the module as seen in the direction of arrows from the line IV—IV of FIG. 3.
Figure 4A:
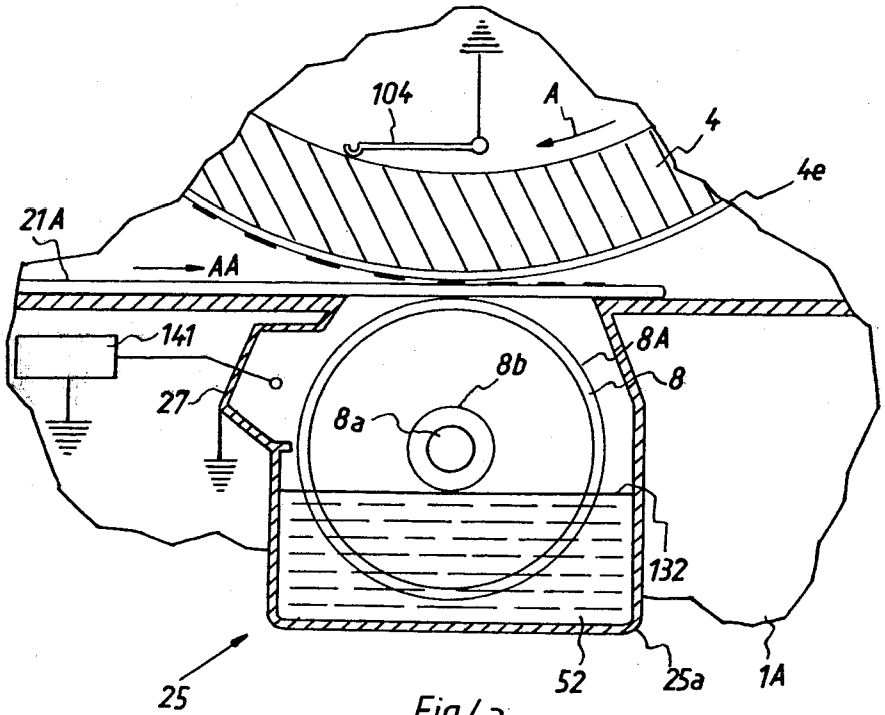
FIG. 4a is an enlarged view of a detail in FIG. 1.

FIGS. 3 and 4 show that the casing 2A of the module 2 comprises two spaced apart vertical side walls 2*a*, 2*b*, which flank the copying drum 4 and have convex mounting means or protuberances 40 extending with a certain amount of play into complementary concave recesses or sockets 4*c*, 4*d* provided in the central portions of the adjacent end faces of the drum 4. All that is necessary is to insure that the protuberances 40 can loosely mount the drum 4 during insertion of the module 2 into or during its removal from the main housing portion 1A. The drum 4 can be removed from the casing 2A by pivoting or shifting one of the side walls 2*a*, 2*b* away from the other side wall or by removably mounting one or both protuberances 40 on the respective side walls. The protuberances 40 may extend into the respective sockets 4*c*, 4*d* with a substantial amount of clearance. Proper centering of the drum 4 in the housing 1 takes place automatically when the casing 2A is placed onto the supporting members 3 and the cover 35 is pivoted back to the position shown in FIG. 1 because the drum is then engaged and properly located by the rollers 6, 7 and 8.

The major portion of the casing 2A is hollow and its interior is subdivided into three chambers or compartments 43, 44, 45 by a downwardly extending partition 2*c* and an upwardly extending partition 2*d.* The median chamber 44 communicates with the chambers 43, 45 by way of passages 41, 42 which are respectively disposed below the partition 2*c* and above the partition 2*d.* An open side of the first chamber 43 is adjacent to the drum 4, and this is rotatably journalled in the side walls 2*a*, 2*b* of the casing 2A. The shaft 47 preferably extends beyond the side wall 2*b* and carries a gear 48 which receives torque from the prime mover PM in the housing portion 1A when the casing 2A of the module 2 rests on the supporting members 3 and the prime mover is on. FIG. 3 shows by phantom lines a gear 48*a* which forms part of the aforementioned power train and meshes with the gear 48 when the module 2 is properly mounted in the housing 1. The bristles 46*a* of the brush 46 sweep remnants of toner and/or carrier particles from the photosensitive layer 4*e* and propel the removed particles toward and into the passage 41, i.e., into the median chamber 44. The bristles 46*a* are flexed by a bar- or strip-shaped flexing device 49 which is installed in the chamber 43 below the brush 46 and promotes propulsion of removed solid particles into the passage 41.

That wall of the outermost chamber 45 which is parallel to and remote from the partition 2*d* constitutes an air-permeable screen 50 which intercepts toner particles but permits currents of air to pass therethrough. When the module 2 is properly installed in the housing 1, the screen 50 is adjacent to the suction side of a fan 32 (FIGS. 1 and 2) which is driven to draw streams of air into and from the chamber 43. Such air flows past the brush 46, into the chambers 44, 45, through the screen 50 and is discharged into the atmosphere. The screen 50 intercepts toner particles which are carried by air streams flowing toward the fan 32. This reduces the maintenance cost because toner particles cannot penetrate into and contaminate the housing 1 and/or the surrounding area.

The casing 2A of the module 2 further contains or supports a vessel 51 for a supply of fixing liquid 52. The vessel 51 has a downwardly extending outlet pipe 53 which extends into the tank 25*a* of the unit 25 when the casing 2A rests on the supporting members 3. The pipe 53 forms part of a conventional automatic refilling device which insures that fixing liquid 52 invariably fills the tank 25*a* to a predetermined optimum level. A suitable automatic refilling device similar to that including the outlet pipe 53 is disclosed, for example, in U.S. Pat. No. 2,704,511.

When the drum 4 is to be inspected or replaced with a new drum, the cover 35 is lifted and the module 2 is removed from the main housing portion 1A. The module 2 will also be removed when the chamber 43, 44 and/or 45 has accumulated a substantial quantity of toner particles, when the brush 46 requires replacement with a new brush, when the screen 50 is clogged and/or for other reasons. Upon insertion of a new module 2 (which may but need not contain a new copying drum 4), the pipe 53 automatically enters the tank 25*a* and is ready to supply fixing liquid 52 when necessary, i.e., when the upper surface of liquid in the tank 25*a* descends to a lowermost permissible level. The newly inserted module 2 can be readily located in an optimum position on the supporting members 3. If not, the positioning can take place automatically in response to closing of the cover 35 (refer to the function of edge faces 38). If desired, the supporting members 3 may be formed with sockets or projections cooperating with projections or sockets of a properly inserted casing 2A. The drum 4 is automatically centered in response to closing of the cover 35 because its layer 4*e* rests on the roller 8 and its marginal portions 4*a*, 4*b* are engaged by the wheels of the rollers 6, 7. The machine is ready for use because the drum 4 begins to rotate as soon as the prime mover PM is started, and such prime mover also drives the fan 32 as well as the driver gear 48*a* for the gear 48 on the shaft 47 of the brush 46.

FIG. 4*a* shows the details of the combined transfer and fixing or fusing unit 25. The roller 8 of this unit is coated with a layer 8A of dielectric material and dips into a supply of fixing liquid 52 in the tank 25*a* which is mounted in the main portion 1A of the housing. The roll 22 (FIG. 1) is assumed to feed a copy carrier 21A in the direction indicated by arrow AA. The body of the copying drum 4 is grounded, as at 104, and its photosensitive layer 4*e* is assumed to consist of selenium. The shaft 8*a* of the roller 8 is mounted in the walls of the tank 25*a* or in the main portion 1A directly below the lowermost point of the copying drum 4. The roller 8 is rotatable on suitable antifriction bearings 8*b*.

The corotron 27 is connected with a generator 141 and is mounted in the tank 25*a* above the level 132 of liquid 52.

When the roll 22 advances a copy carrier 21A into the nip of the drum 4 and roller 8, the layer 8A applies a film of liquid 52 to the underside of the copy carrier. This results in transfer of powder image from the layer 4*e* onto the upper side of the copy carrier 21A and in simultaneous fixing of the transferred image. The copy carrier 21A is then dried at 29 (FIG. 1) and is caused to descend into the chute 30.

The toner particles which are applied to the layer 4*e* by the applicator 18 of the developing unit 15 shown in FIG. 1 contain a soluble ingredient, and the copy carriers 21A are porous so that the liquid 52 can penetrate through the copy carriers and dissolves the soluble ingredients of toner particles. The corotron 27 causes the copy carriers 21A to adhere to the layer 8*a* to thus insure proper wetting of successive increments of a copy carrier which passes between the layers 4*e* and 8A as well as the fixing of entire powder image while the copy carrier advances toward and onto the belt conveyor 28. The corotron 27 further insures that the copy carriers 21A are advanced at a predictable speed because they are caused to adhere to the uppermost portion of the layer 8A on the roller 8. The latter performs several functions, namely effecting the transfer of powder images from layer 4*e* onto copy carriers 21A, assisting in transport of copy carriers 21A toward the belt conveyor 28, fixing the transferred powder images, and centering the drum 4.

Figure 5:
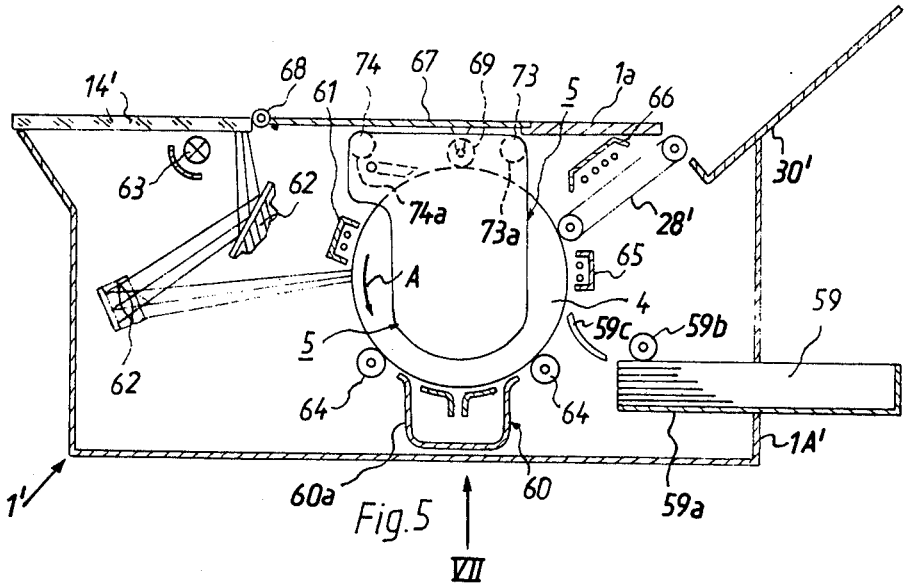
FIG. 5 is a schematic longitudinal vertical sectional view of a second copying machine which employs a different module, the movable portion of the housing of the copying machine being shown in closed position.
Figure 6:
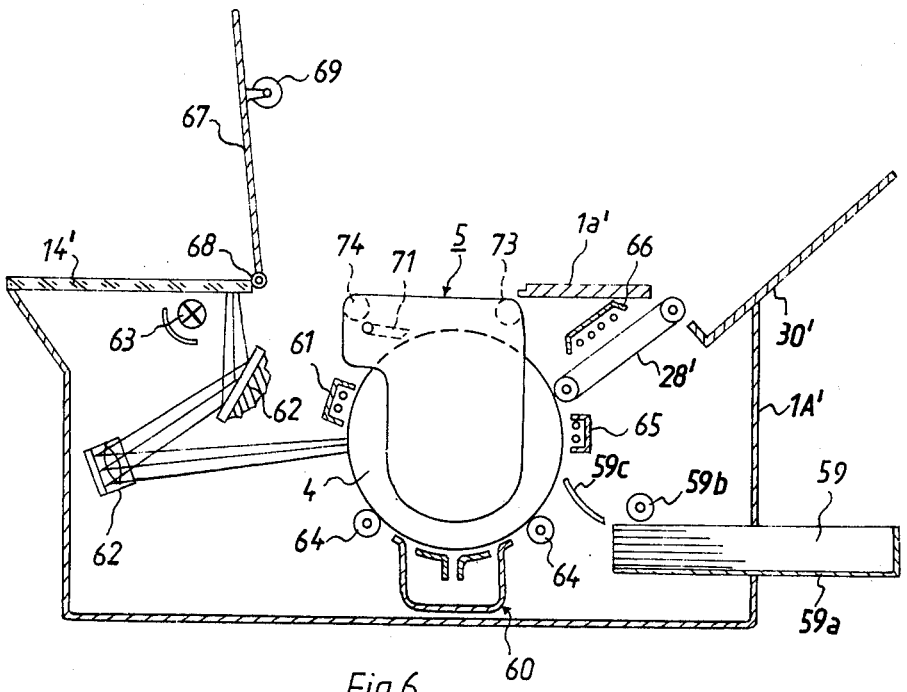
FIG. 6 illustrates the structure of FIG. 5 but with the movable housing portion in open position to afford access to the module in the stationary portion of the housing.
Figure 7:
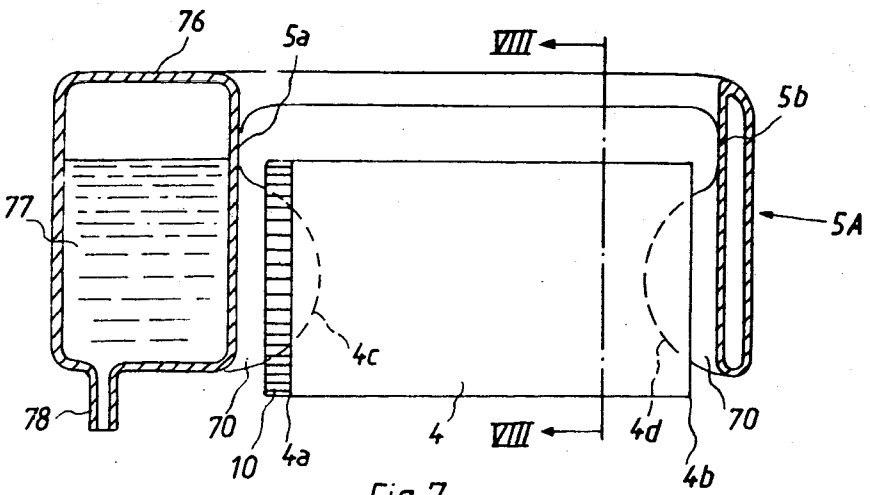
FIG. 7 is an enlarged end elevational view of the module of FIGS. 5 – 6 as seen in the direction of arrow VII in FIG. 5, a portion of the casing of the module being shown in section.
Figure 8:
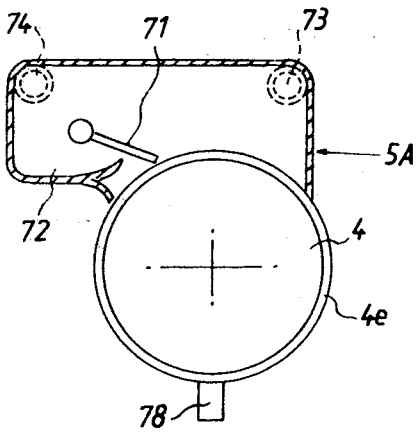
FIG. 8 is a sectional view as seen in the direction of arrows from the line VIII—VIII of FIG. 7.

FIGS. 5 and 6 show a second copying machine with a module 5 the details of which are illustrated in FIGS. 7 and 8. When the copying drum 4 of the module 5 rotates in the direction indicated by arrow A, its photosensitive layer 4*e* travels past a corona 61 which is installed in the main portion 1A' of the housing 1', thereupon past an exposing unit 62 including a light source 63, a developing unit 60 which employs a liquid developing agent, a tray 59*a*, for a stack 59 of sheet-like copy carriers, a stripping corona 65, and a belt conveyor 28' whose upper reach moves below a dryer 66 while such upper reach advances a copy carrier into a second tray 30' replacing the chute 30 of FIGS. 1–2. The transparent platform 14' for originals is mounted in the top wall 1*a'* of the main portion 1A'. A portion 67 of the top wall 1*a'* constitutes a cover or lid 67 which is pivotable about the axis of a hinge 68 and carriers a centering roller 69 for the drum 4. A roll 59*b* feeds discrete copy carriers along an arcuate guide 59*c* and into the space between the layer 4*e* and the corona 65. The main portion 1A' of the housing 1' contains two additional centering rollers 64 one of which is coupled to the prime mover (not shown) so that it can transmit torque to the copying drum 4 when the casing 5A of the module 5 is properly installed in the main portion 1A'. FIG. 7 shows that the drum 4 is loosely supported by convex protuberances 70 of the side walls 5*a*, 5*b* of the casing 5A. The protuberances 70 extend into adjacent concave sockets 4*c*, 4*d* in the end faces of end portions 4*a*, 4*b* of the drum 4. The brush 46 of FIGS. 1–2 is replaced with a flexible or rigid doctor 71 which is mounted in the casing 5A and serves to remove remnants of liquid developing agent from the photosensitive layer 4*e* and to direct such remnants into an intercepting receptacle 72. The upper portion of the casing 5A is provided with pins or studs 73, 74 which can be inserted from above into complementary recesses or sockets 73*a*, 74*a* of the main housing portion 1A'.

That end portion 4*a* of the drum 4 which is formed with the ring gear 10 is adjacent to a vessel 76 for liquid developing agent 77. The vessel 78 has an outlet pipe 78 which can supply liquid developing agent into the tank 60*a* of the developing unit 60 when the module 5 is properly installed in the main housing portion 1A'. The pipe 78 admits liquid developing agent 77 into the tank 60*a* whenever the quantity of agent in the tank 60*a* is reduced to a predetermined minimum level.

If a module 5 is to be removed from the housing 1', the cover 67 is pivoted to the open position of FIG. 6 whereby the centering roller 69 is lifted above and away from the drum 4. The module 5 can be lifted off the centering rollers 64 in the main housing portion 1A' by lifting the studs 73, 74 out of the respective recesses 73*a*, 74*a*. The copying machine of FIGS. 5–6 need not employ a fan because the images which are exposed onto the layer 4*e* of the drum 4 are developed with a liquid agent.

An additional different between the modules 2 and 5 is that the drum 4 of FIGS. 5–8 is located at the lower end of the casing 5A when the module 5 is properly installed in the housing portion 1A'. In FIGS. 1–2, the drum 4 is located at the inner end of the casing 2A, i.e., at that end of this casing which is remote from the fan 32.

The manufacturing cost of the module 2 and/or 5 can be reduced by making a portion of or the entire casing 2A and/or 5A of a suitable synthetic plastic material. Furthermore, the weight of a plastic casing is only a fraction of the weight of a metallic casing. Also, a plastic casing is more likely to withstand the corrosive action of liquid in the vessel 51 or 76.

An important advantage of the improved copying machine is that the removal of a module or insertion of a module takes up very little time and that the work can be performed by semiskilled or even unskilled persons. Accurate centering of the drum 4 is effected by rollers 6–8 or 64, 64 69 all of which are in optimum positions to accurately center and locate the drum not later than when the cover 35 or 67 is caused to assume the closed position of FIG. 1 or 5. Furthermore, the person in charge of inserting a fresh module need not be concerned with the means for rotating the drum 4 because such means is automatically coupled to and is ready to rotate the drum not later than when the cover is returned to closed position. As illustrated and described, one or more centering members may be mounted in a stationary part (main portion) or in a movable part (cover) of the housing. While the rollers 64 of FIGS. 5–6 can center and support the drum 4 of a properly inserted module 5, the provision of at least one additional centering member on the cover is advisable and often desirable in order to insure that the drum is accurately centered by more than two members which are distributed (as considered in the circumferential direction of the drum) in such a way that the drum retains its position even if the housing 1 or 1′ is vibrated or otherwise moved, as long as the cover remains in the closed position.

Without further analysis, the foregoing will so fully reveal the gist of the present invention that others can by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. In an electrostatic copying machine, a combination comprising a housing; centering means in said housing; a self-sustaining module removably mounted in said housing and including a casing, a mobile copying component installed in said casing; and means for cleaning said component, said cleaning means being mounted in said casing; said centering means engaging and locating said component and including at least one motion transmitting member actuatable to move said component with respect to said housing.

2. A combination as defined in claim 1, wherein said component is a rotary drum having a photosensitive layer at the periphery thereof, said cleaning means comprising a device which sweeps said layer when said drum is rotated by said motion transmitting member.

3. A combination as defined in claim 2, wherein said centering means comprises a plurality of rotary members, said module further having means for loosely mounting said drum in said casing.

4. A combination as defined in claim 1, wherein said housing comprises a first portion and a second portion movable with respect to said first portion between first and second positions in which said second portion respectively affords and prevents access to said module.

5. A combination as defined in claim 4, wherein said centering means comprises a plurality of rollers one of which constitutes said motion transmitting memeber, at least one of said rollers being mounted in said first portion and at least one of said rollers being mounted in said second portion to engage said component in said second position of said second portion.

6. A combination as defined in claim 4, wherein said second portion is pivotable between said first and second positions thereof.

7. A combination as defined in claim 1, wherein said component is a rotary drum having two end faces and recesses in said end faces, said casing comprising end walls adjacent to said end faces and having protuberances extending with clearance into the respective recesses.

8. A combination as defined in claim 7, wherein said recesses are concave sockets located centrally of the respective end faces and said protuberances have convex surfaces.

9. A combination as defined in claim 1, wherein said component is a rotary drum having first and second end portions and an annulus of gear teeth at one of said end portions, said motion transmitting member including a gear meshing with the teeth of said one end portion.

10. A combination as defined in claim 1, wherein said component is a rotary drum and said cleaning means comprises a brush having bristles contacting the periphery of said drum.

11. A combination as defined in claim 10, wherein said brush is rotatable about an axis which is parallel to the axis of said drum and has a shaft journalled in said casing, and further comprising drive means for rotating said shaft, said drive means being mounted in said housing and being actuatable to rotate said shaft when said drum is engaged and located by said centering means.

12. A combination as defined in claim 11, wherein said shaft has a first gear and said drive means comprises a second gear in mesh with said first gear when said module is mounted in said housing.

13. A combination as defined in claim 1, wherein said component is a rotary drum and said cleaning means comprises a strip-shaped doctor engaging the periphery of said drum.

14. A combination as defined in claim 1, wherein said component is a rotary drum having a periphery provided with a photosensitive layer, and further comprising means for exposing images of originals onto said layer and means for developing images on said layer, said developing means comprising means for applying solid toner particles to said layer and said cleaning means comprising a device for removing surplus toner particles from said layer downstream of said developing means.

15. A combination as defined in claim 14, further comprising a fan for inducing the flow of air streams in said casing past said device, said casing having at least one chamber for collecting toner particles which are entrained by said streams.

16. A combination as defined in claim 14, wherein said fan is mounted in said housing and said casing includes an air-permeable portion adjacent to said fan.

17. A combination as defined in claim 1, wherein said casing comprises a vessel for a supply of liquid.

18. A combination as defined in claim 17, wherein said liquid is a developing agent.

19. A combination as defined in claim 17, wherein said liquid is a fixing agent.

20. A combination as defined in claim 17, further comprising a tank provided in said housing, said vessel having an outlet arranged to supply liquid to said tank.

21.. A combination as defined in claim 1, wherein at least a portion of said casing consists of synthetic plastic material.

* * * * *